US006926379B1

(12) United States Patent
Grace et al.

(10) Patent No.: US 6,926,379 B1
(45) Date of Patent: Aug. 9, 2005

(54) DOOR BRACE FOR A REFRIGERATOR CABINET ASSEMBLY HAVING VARYING WIDTH COMPARTMENT DOORS

(75) Inventors: James M. Grace, Elberon, IA (US); Roger C. Miersen, Marion, IA (US); Douglas A. Pohl, Davenport, IA (US); Eugene H. Schuchert, Iowa City, IA (US)

(73) Assignee: Maytag Corporation, Newton, IA (US)

( * ) Notice: Subject to any disclaimer, the term of this patent is extended or adjusted under 35 U.S.C. 154(b) by 26 days.

(21) Appl. No.: 10/902,045

(22) Filed: Jul. 30, 2004

(51) Int. Cl.[7] ..... A47B 96/04
(52) U.S. Cl. ..... 312/405; 312/401
(58) Field of Search ..... 312/401, 402, 312/404, 405, 406, 407, 407.1, 116; 62/440, 62/441; 49/501; D15/79, 81

(56) References Cited

U.S. PATENT DOCUMENTS 2,696,644 A * 12/1954 De Graw ..... 52/223.6
4,747,245 A 5/1988 Lesmeister et al.
5,899,546 A 5/1999 Avendano et al.
D418,845 S 1/2000 Jackovin
6,019,447 A 2/2000 Jackovin
D431,577 S 10/2000 Jackovin
6,209,265 B1 4/2001 Banicevic et al.
6,629,339 B2 * 10/2003 Pohl et al. ..... 16/436

* cited by examiner

*Primary Examiner*—James O. Hansen
(74) *Attorney, Agent, or Firm*—Kirk W. Goodwin

(57) ABSTRACT

A side-by-side refrigerator includes fresh food and freezer compartments, each having upper and lower sections which vary in width and volume. Doors, each having corresponding upper and lower sections that vary in width, are provided to selectively seal the fresh food and freezer compartments respectively. Each door includes an outer lateral portion pivotally mounted to the side-by-side refrigerator about a substantially vertical axis and an inner lateral portion defined by laterally offset sections that form the varying width portions. In accordance with the invention, a door brace member is provided at the laterally offset sections. The door brace member includes first and second substantially vertical portions interconnected by a lateral portion that is shaped to conform to and reinforce the laterally offset sections of the door to increase the overall structural integrity of the door.

15 Claims, 7 Drawing Sheets

DOOR BRACE FOR A REFRIGERATOR CABINET ASSEMBLY HAVING VARYING WIDTH COMPARTMENT DOORS

BACKGROUND OF THE INVENTION

1. Field of the Invention

The present invention pertains to the art of refrigerators and, more particularly, to a door brace for a side-by-side refrigerator including laterally spaced compartment doors, each of which includes sections of differing widths.

2. Discussion of the Prior Art

In a conventional side-by-side refrigerator, freezer and fresh food compartment doors align along a vertically extending divider wall or mullion, with the mullion extending in a single plane essentially from the top to the bottom of the refrigerator. Although this style of refrigerator has certain advantages over either a top-mount or a bottom-mount refrigerator wherein the freezer compartment is arranged vertically above or below the fresh food compartment respectively, certain disadvantages are also presented. For instance, since the opening provided in a household kitchen for side-by-side, top-mount and bottom-mount style refrigerators is essentially standard, top-mount and bottom-mount refrigerators typically have wider shelves in each of the fresh food and freezer compartments as compared to the corresponding shelves in a side-by-side refrigerator.

For this reason, it is often difficult, if not impossible, to accommodate rather wide food items, such as trays, cake pans, platters, turkeys and the like, on a given shelf in the fresh food compartment of a side-by-side refrigerator, while the same item(s) could be readily placed on a corresponding shelf in a top-mount or bottom-mount refrigerator. The same is true with respect to the width of different freezer shelves. For example, it is not always possible to store frozen pizza and other large food items widthwise in a side-by-side refrigerator freezer compartment, while such items can be easily arranged widthwise in a freezer compartment of a top-mount or bottom-mount style refrigerator. To compensate for this disadvantage, it is not uncommon for owners of side-by-side refrigerators to purchase a second refrigerator for additional food storage space.

Alternatively, a side-by-side refrigerator can be constructed with fresh food and freezer compartments of varying widths as demonstrated in U.S. Pat. No. 6,019,447. With this advantageous construction, a consumer can arrange larger width items in a larger width area of the refrigerator, while small width items can be placed on shelves located in a narrower width section. In order to seal each of the varying width compartments, the refrigerator illustrated in the '447 patent includes fresh food and freezer compartment doors having varying widths. That is, each of the fresh food and freezer compartment doors includes an inner lateral portion defined by offset vertical sections interconnected by a lateral section.

It is also known in the art of refrigerators to provide structural support at corner portions of fresh food and freezer compartment doors where hinges are attached to pivotally mount the fresh food and freezer compartment doors to the cabinet. However, these door supports do not address problems associated with thermal bowing in other portions of the door which can negatively affect the integrity of a door seal employed to prevent cool air from escaping the refrigerator. A particular problem exists with the type of refrigerators discussed above that have offset vertical sections. That is, the laterally offset sections define a zone of interruption that takes a significant amount of strength out of the overall door. Based thereon, this zone of interruption can experience a significant amount of thermal bow which can cause a breach of the door seal at this zone. In addition, unless adequately supported, refrigerator doors having offset vertical sections may also be limited in the amount or weight of items that can be stored in bins or shelves on the door. Too much weight could cause the seal about the door to unseat allowing cool air to escape from the refrigerator.

Based on at least these reasons, there exists a need in the art for a reinforcing member for a refrigerator door. More specifically, there exists a need for a reinforcing member that can increase the structural integrity of offset vertical sections of a varying width refrigerator door so as to increase the overall storage capacity of the door, while assuring door seal integrity.

SUMMARY OF THE INVENTION

The present invention is directed to a structural support arrangement for varying width fresh food and freezer doors provided on a varying width refrigerator. In accordance with the invention, the varying width refrigerator includes a cabinet shell and at least one liner positioned within the cabinet shell in order to define laterally spaced, fresh food and freezer compartments separated by a fore-to-aft extending divider wall. The divider wall includes first and second interconnected upright portions which are laterally offset to form fresh food and freezer compartments having varying lateral dimensions. Correspondingly, the refrigerator is provided with fresh food and freezer doors, each including an outer lateral portion pivotally mounted to the cabinet shell about a substantially vertical axis and an inner lateral portion defined by laterally offset sections. In this manner, the fresh food and freezer doors have vertically offset, varying width portions adapted to extend across and seal the fresh food and freezer compartments respectively.

In accordance with the invention, each of the fresh food and freezer compartment doors is provided with a door brace member. More specifically, the door brace members are secured to the laterally offset sections to provide structural support for the varying width portions of the fresh food and freezer doors. In accordance with one embodiment of the present invention, the door brace member includes first and second substantially vertical sections interconnected by a lateral section. Preferably, each of the substantially vertical sections is provided with an in-turned flange that is adapted to nest within a corresponding flange provided on a respective one of the fresh food and freezer doors. More specifically, the in-turned flange extends along an edge portion of the substantially vertical section of the door brace member. In addition, at least one of the substantially vertical sections includes a support flange that extends along an opposing edge portion, opposite the in-turned flange, with the support flange positioning the door brace member at the laterally offset section.

In accordance with another embodiment of the present invention, the door brace member includes a back plate element provided between one of the first and second substantially vertical sections and the lateral section. In accordance with this embodiment of the invention, the back plate member includes a leg member that extends from the back plate, with the leg member being adapted to rest upon the lateral section. The back plate member is positioned so as to provide additional support, when required, for a door handle for a respective one of the fresh food and freezer doors.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
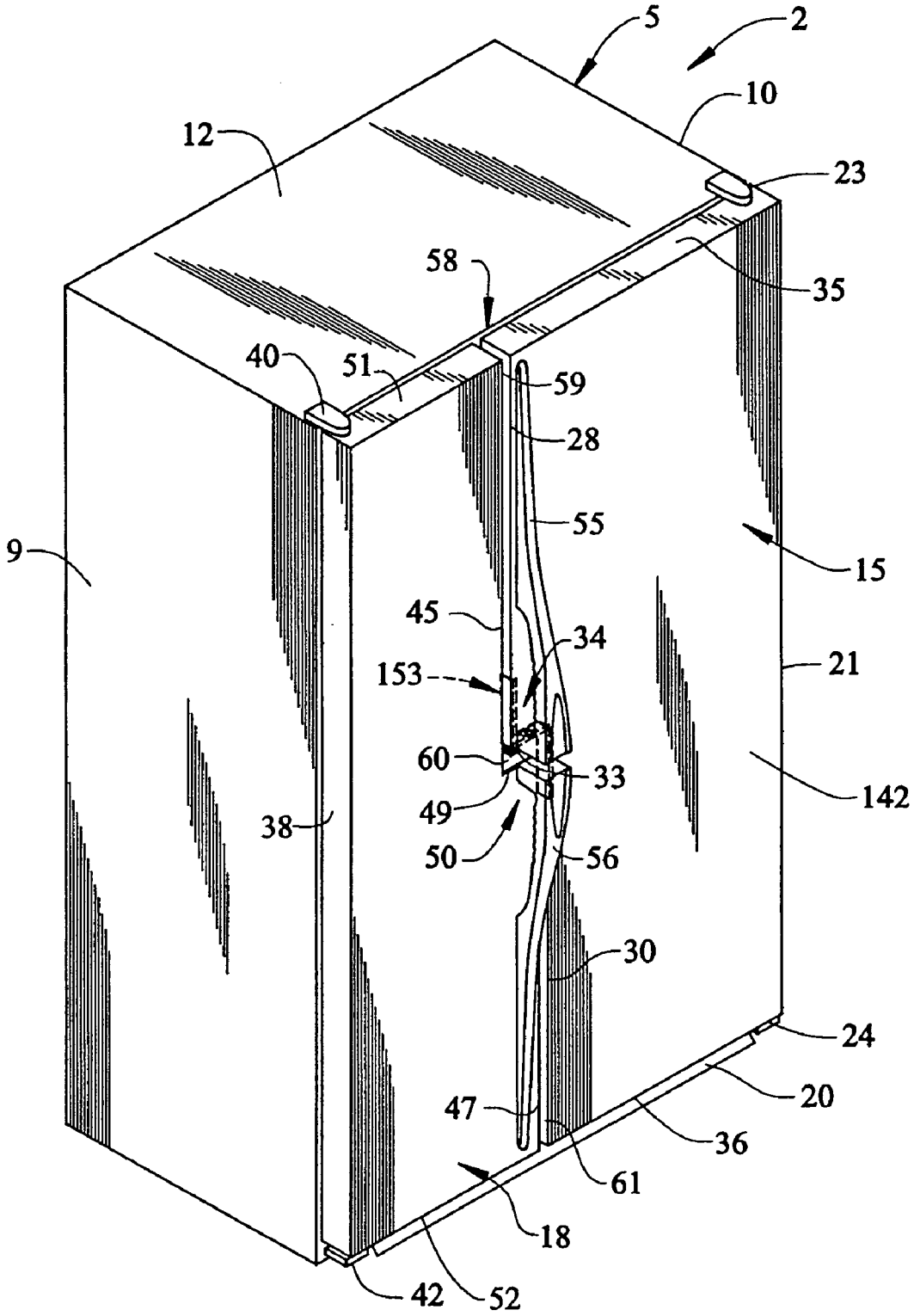
FIG. 1 is an upper left perspective view of a side-by-side refrigerator having varying width doors including a door brace member constructed in accordance with the present invention shown in phantom positioned on laterally offset vertical portions of one of the varying width doors.

With initial reference to FIG. 1, a refrigerator cabinet constructed in accordance with the present invention is generally indicated at 2. In general, refrigerator cabinet 2 includes a cabinet shell 5 formed from side panels 9 and 10 which are interconnected by a top panel 12. Preferably, cabinet shell 5 is formed from bending a single piece of sheet metal in a manner known in the art. As illustrated, refrigerator cabinet 2 constitutes a side-by-side refrigerator having a fresh food compartment door 15 which is arranged laterally juxtaposed a freezer door 18. Extending laterally across cabinet shell 5, below fresh food and freezer doors 15 and 18, is a kick plate 20.

As shown, fresh food door 15 includes an outer vertical edge portion 21 which is pivotally attached to cabinet shell 5 through an upper hinge 23 and a lower hinge 24. As further shown in FIG. 1, fresh food door 15 includes an upper inner edge portion 28, a lower inner edge portion 30 and a lateral edge portion 33 interconnecting the upper and lower inner edge portions 28 and 30. Therefore, upper and lower edge portions 28 and 30 are laterally spaced and extend in vertically offset planes or axes so as to form a laterally offset portion 34 of refrigerator door 15. In addition, fresh food door 15 includes upper and lower edge portions 35 and 36 that connect vertical edge portion 21 with upper and lower inner edge portions 28 and 30 respectively. In a generally similar manner, freezer door 18 includes an outer edge portion 38 which is pivoted at an upper hinge 40 and a lower hinge 42 for movement relative to cabinet shell 5. In addition, freezer door 18 includes an upper inner edge portion 45, a lower inner edge portion 47 and a lateral edge portion 49. At this point, it should be understood that, while lateral edge portions 33 and 49 are shown to extend generally horizontally, these lateral portions could be curvilinear, diagonal or the like without departing from the invention. In any event, upper inner edge portion 45, lower inner edge portion 47 and lateral edge portion 49 form an associated laterally offset portion 50 for freezer door 18. In a manner similar to that described with respect to fresh food door 15, freezer door 18 includes upper and lower edge portions 51 and 52 that interconnect outer edge portion 38 with upper and lower inner edge portions 45 and 47 respectively. Also shown in FIG. 1, fresh food door 15 is provided with a handle 55. Likewise freezer door 18 is provided with a corresponding handle 56.

With this construction, as opposed to a conventional side-by-side refrigerator wherein inner edge portions of fresh food and freezer doors would be spaced by a vertical, single axis gap, fresh food and freezer doors 15 and 18 are spaced in a central zone of refrigerator cabinet 2 by a gap 58 that includes a first vertical component 59 between upper inner edge portions 28 and 45, a lateral component 60 between lateral edge portions 33 and 49 and a second vertical component 61 between lower inner edge portions 30 and 47. Therefore, fresh food door 15 is wider in an upper region thereof than in a lower portion. Correspondingly, freezer door 18 is wider in a lower portion than in an upper portion. As will become more fully evident below, fresh food and freezer doors 15 and 18 conceal corresponding fresh food and freezer compartments of refrigerator cabinet 2 which also have varying width upper and lower sections in accordance with the present invention.

Figure 2:
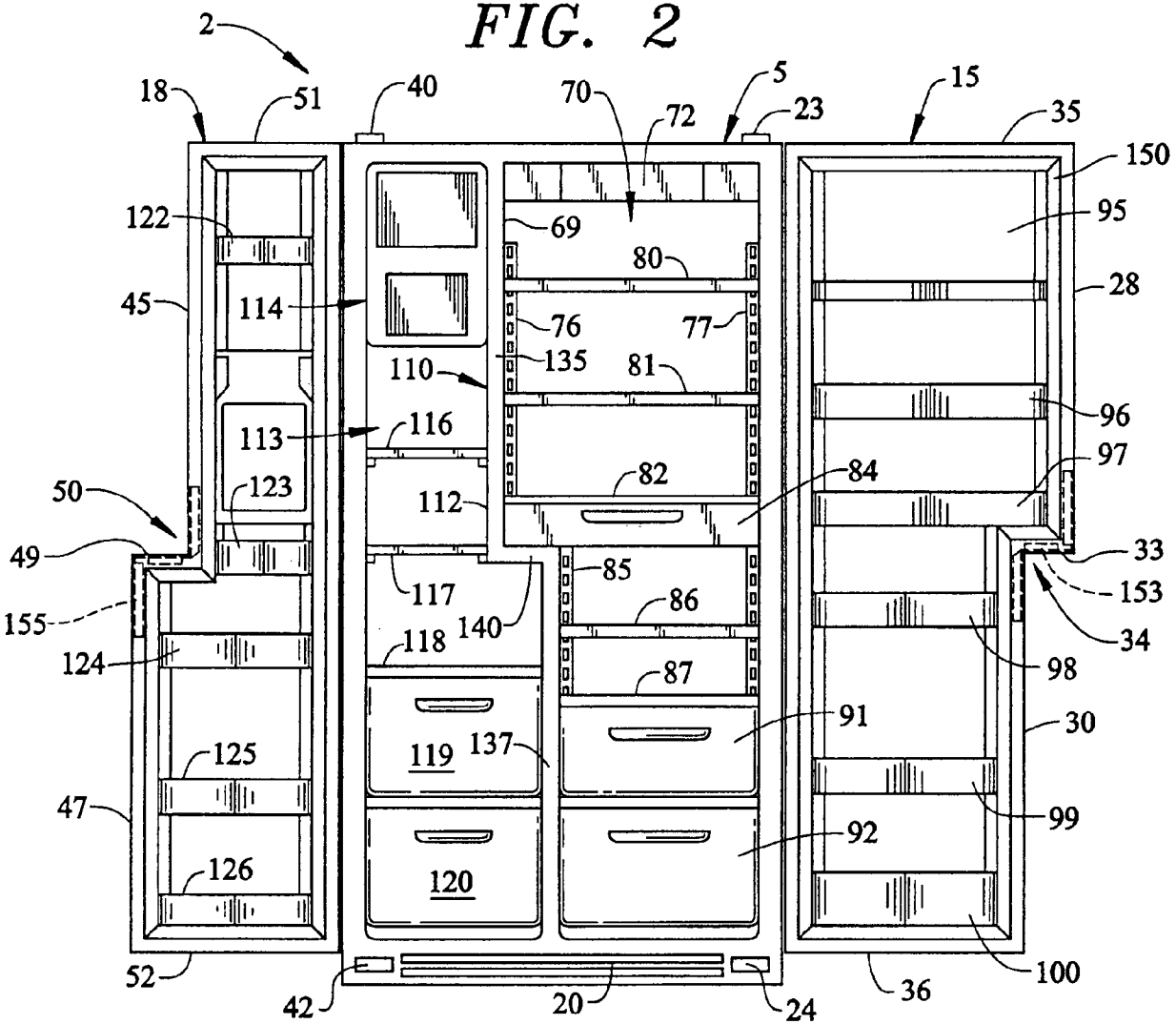
FIG. 2 is a front plan view of the side-by-side refrigerator of FIG. 1 with fresh food and freezer doors thereof shown open.

As best shown in FIG. 2, refrigerator cabinet 2 has mounted therein a liner 69 which defines a fresh food compartment 70. In the embodiment shown, a temperature control unit 72 is shown mounted at an upper portion of fresh food compartment 70 for controlling a temperature in fresh food compartment 70. In addition, laterally spaced vertical rails 76 and 77 are secured to rear wall portions of liner 69 in order to support vertically adjustable shelves 80–82. Shelf 82 is also shown to support a drawer 84. As shown in this figure, rail 77 extends below drawer 84 and is used in combination with a laterally offset intermediate rail 85 to support additional shelves 86 and 87. Finally, refrigerator cabinet 2 includes slidable storage bins 91 and 92 arranged at a lower portion of fresh food compartment 70.

Except for varying in width from typical side-by-side fresh food compartment shelves, drawers and bins, the construction and mounting of shelves 80–82, 86 and 87, drawer 84 and bins 91 and 92 are commonly known in the art. Fresh food door 15 can also be provided with various food item storage units, such as a dairy compartment 95, shelves 96–99, a bin 100 and the like. Again, these storage units are known in the art and it is to be understood that they merely depict exemplary storage arrangements provided for the sake of completion. In addition, it should be realized that refrigerator 2 includes a compartment dividing wall or mullion 110.

In a similar manner, a freezer liner 112 is mounted within cabinet shell 5 that defines a freezer compartment 113. In the embodiment shown, freezer compartment 113 has mounted therein an ice maker unit generally indicated at 114, various vertically spaced shelves 116–118 and lower most slidable bins 119 and 120. The inside of freezer door 18 is shown to support various shelves 122–126. Again, all of these food item supporting units are known in the art and have simply been sized to correspond to the various storage areas shown. Most importantly, it should be realized that fresh food and freezer compartments 70 and 113 have varying width sections corresponding to that of fresh food and freezer doors 15 and 18. Accordingly, mullion 110 has a different configuration than that found in more conventional side-by-side refrigerators. More specifically, mullion 110 includes an upper vertical portion 135 and a lower vertical portion 137 which are interconnected by a laterally extending portion 140. In general, the above-description is provided for the sake of completeness and sets forth structure previously known in the art, such as in U.S. Pat. No. 6,019,447 which is hereby incorporated by reference, in order to allow a better understanding of the drawings.

Figure 3:
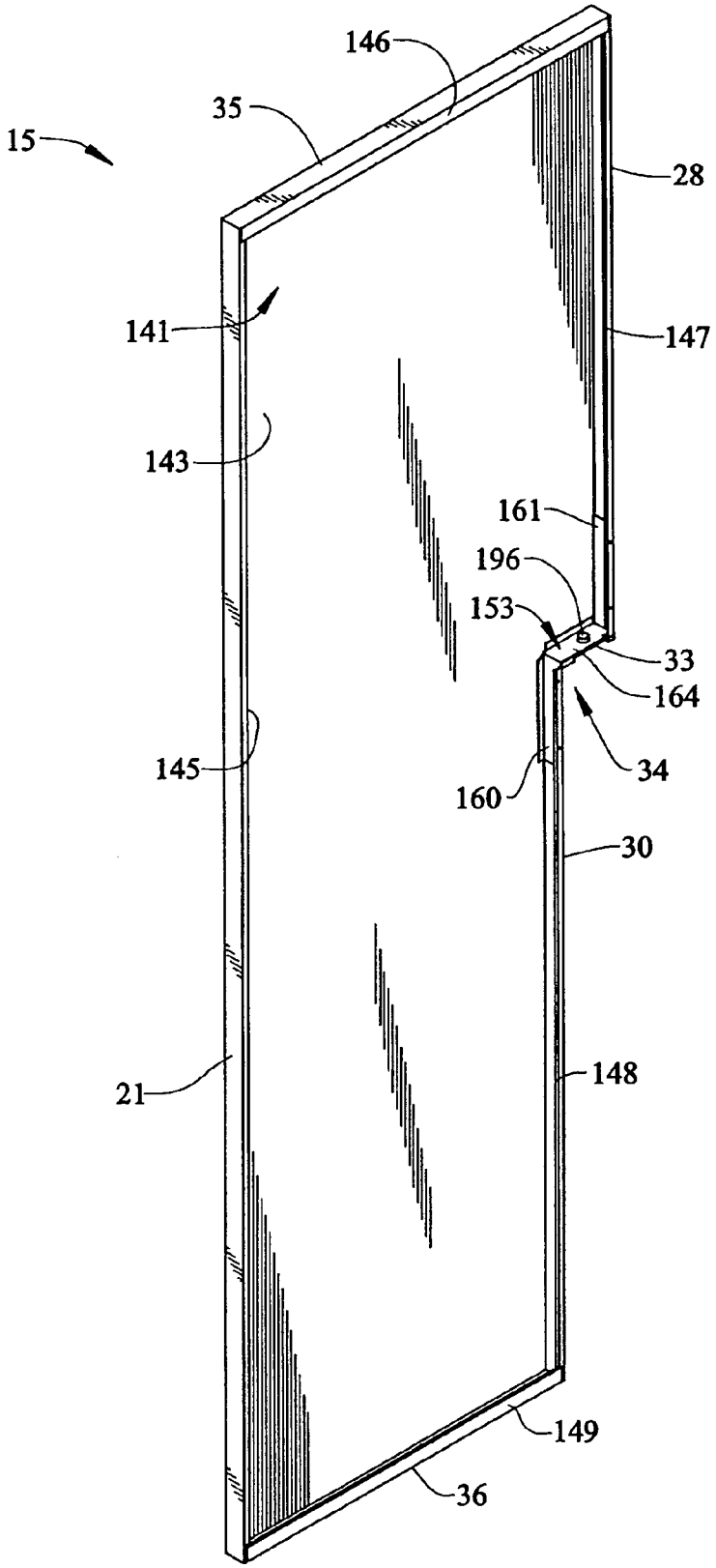
FIG. 3 is a perspective view of an inner portion of one of the varying width doors of FIG. 1 including a door brace member constructed in accordance with a first embodiment of the present invention.
Figure 4:
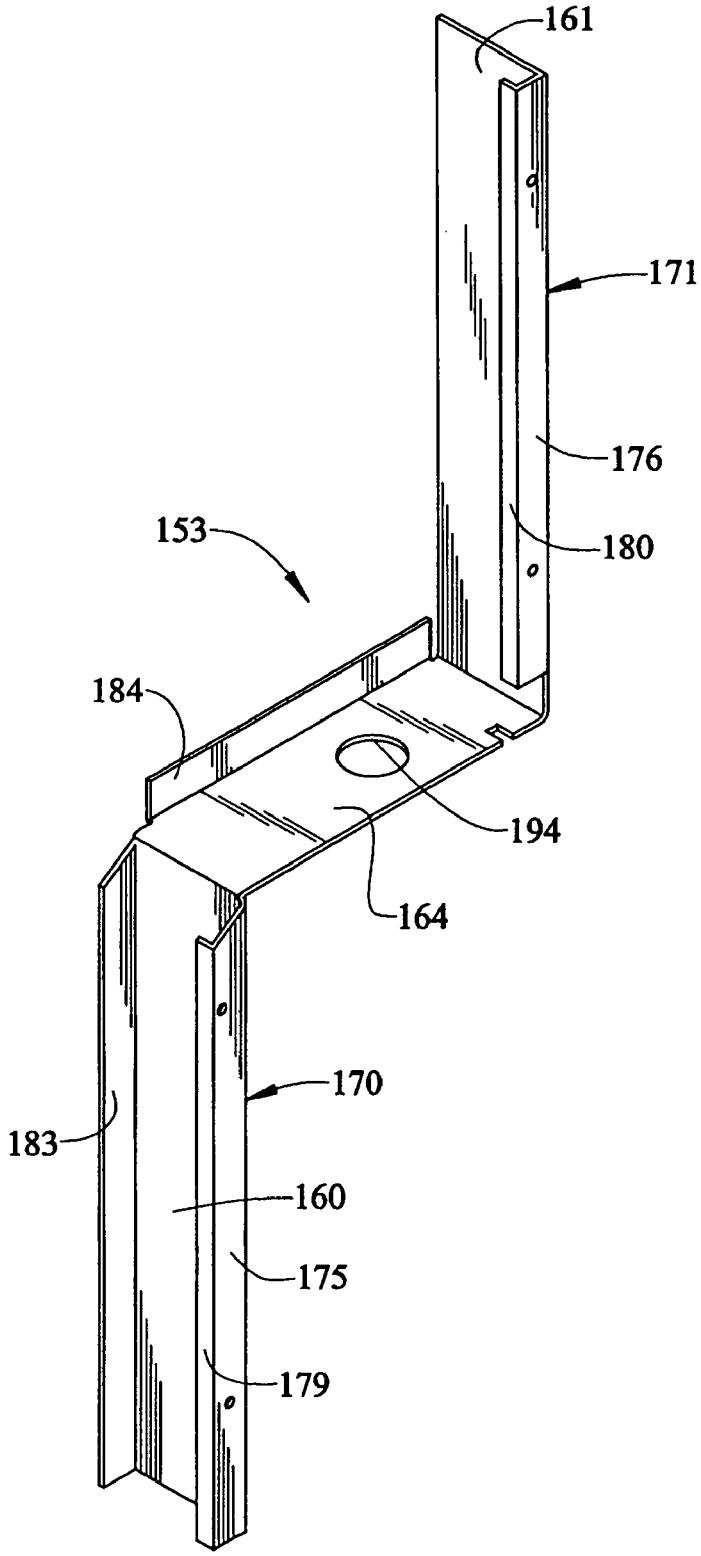
FIG. 4 is an enlarged perspective view of the door brace member of FIG. 3.
Figure 5:
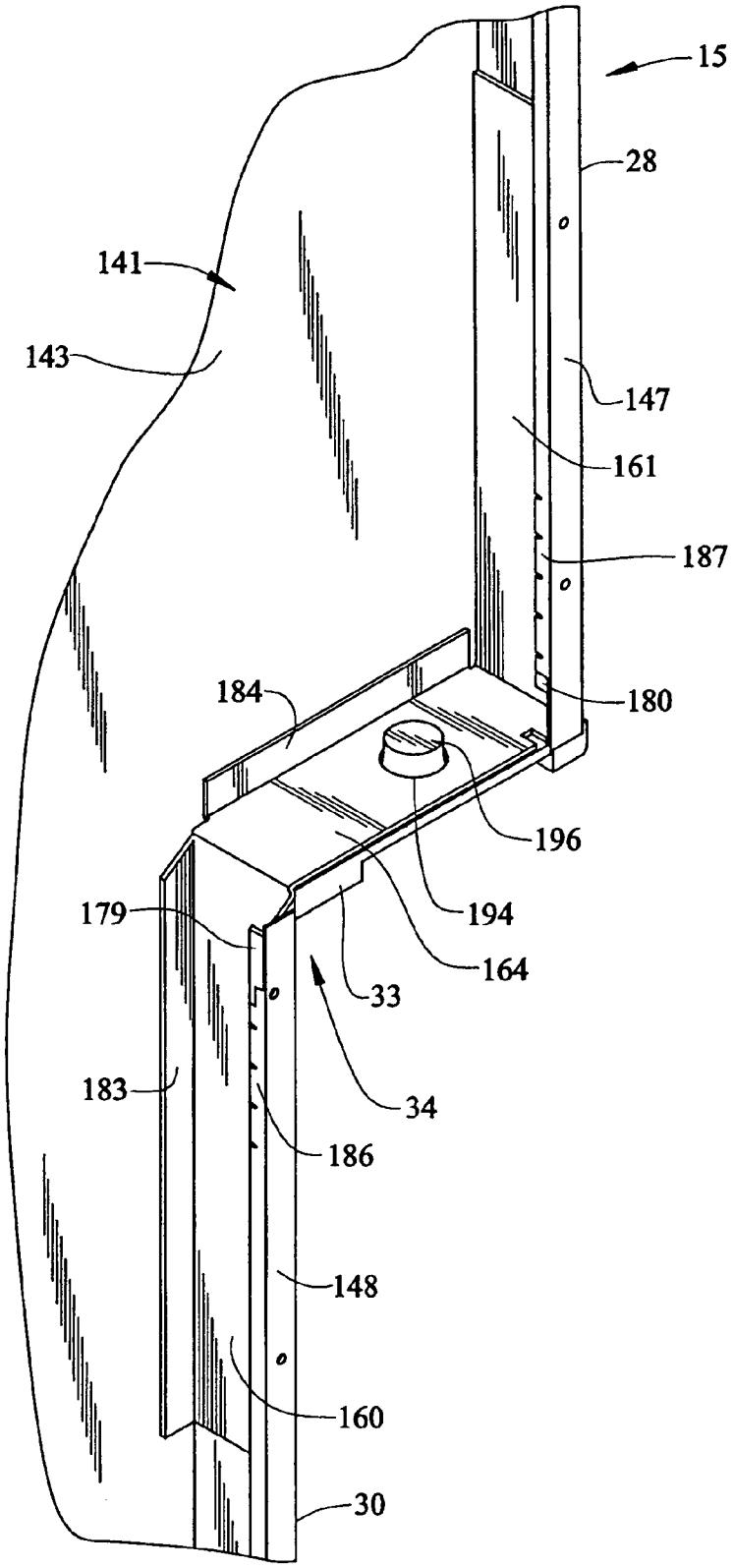
FIG. 5 is an enlarged, partial perspective view of the door brace member of FIG. 4 mounted along an inner portion of the varying width door of FIG. 3.

As fresh food door 15 and freezer door 18 are similarly constructed, a detailed description will be made with respect to fresh food door 15 with an understanding that freezer door 18 has corresponding structure. As best shown in FIGS. 3–5, fresh food door 15 is preferably formed from a single sheet of metal so as to establish a panel section 141 including a front face 142 (shown in FIG. 1), a rear portion 143 provided with a plurality of in-turned flanges 145–149, and an inner liner 150. The present invention is particularly directed to door brace members, such as those indicated in FIG. 2 at 153 and 155.

In accordance with a preferred form of the invention, door brace members 153 and 155 extend along laterally offset portions 34 and 50 of fresh food door 15 and freezer door 18 respectively. However, as door brace members 153 and 155 constitute mirror images of one another, a detailed description will be made with reference to door brace 153 with an understanding that door brace 155 is similarly formed. With particular reference to FIGS. 3–5, door brace member 153 includes a first vertical section 160 and a second vertical section 161 that are joined by a lateral section 164. First and second vertical sections 160 and 161 are formed with respective in-turned flanges 170 and 171 that are adapted to nest into in-turned flanges 148 and 147 of fresh food door 15 respectively. Thus, each in-turned flange 170, 171 includes a corresponding first segment 175, 176 that extends substantially perpendicularly from first and second vertical sections 160, 161 respectively.

Each first segment 175, 176 leads to a second segment 179, 180 that extends generally perpendicularly inward from each first segment 175, 176. In addition, door brace member 153 is provided with a plurality of support flanges, two of which are indicated at 183 and 184 that, in the embodiment shown, project perpendicularly from first vertical section 160 and lateral section 164. Furthermore, lateral section 164 is provided a locating recess or opening 194 adapted to matingly engage with a locating element 196 that projects from lateral edge portion 33 of fresh food door 15. With this construction, door brace member 153 can be secured to fresh food door 15, as represented in FIG. 5, without requiring fasteners or other joining means that may rust or degrade over time. Thus, in accordance with the most preferred embodiment of the present invention, door brace member 153 is secured to laterally offset portion 34 through a plurality of tab elements indicated at 186 and 187 formed on in-turned flanges 148, 147 respectively. More specifically, once door brace member 153 is positioned, tab elements 186 and 187 are crimped onto and about second segments 179 and 180.

Figure 6:
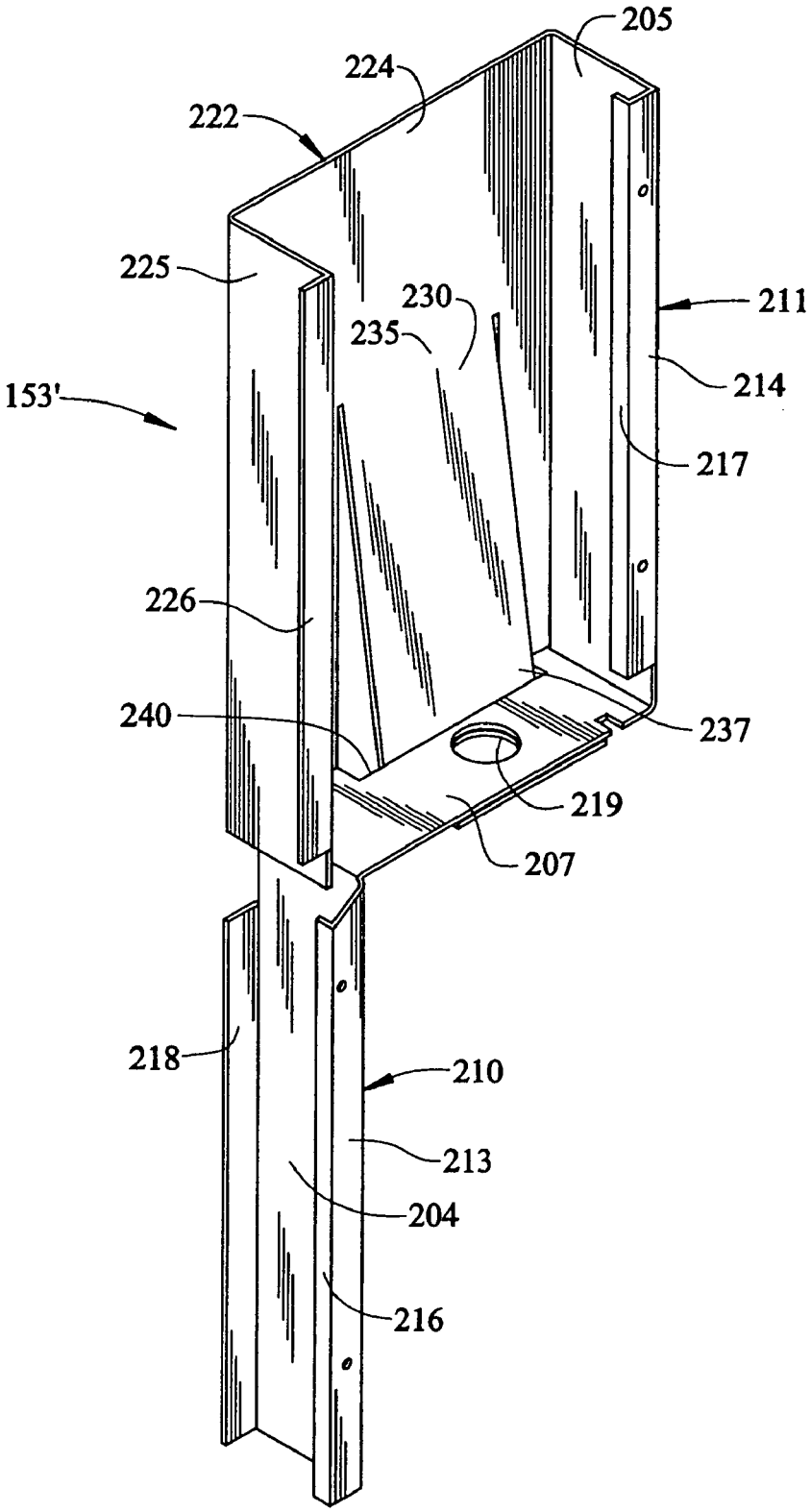
FIG. 6 is a perspective view of a door brace member constructed in accordance with a second embodiment of the present invention.
Figure 7:
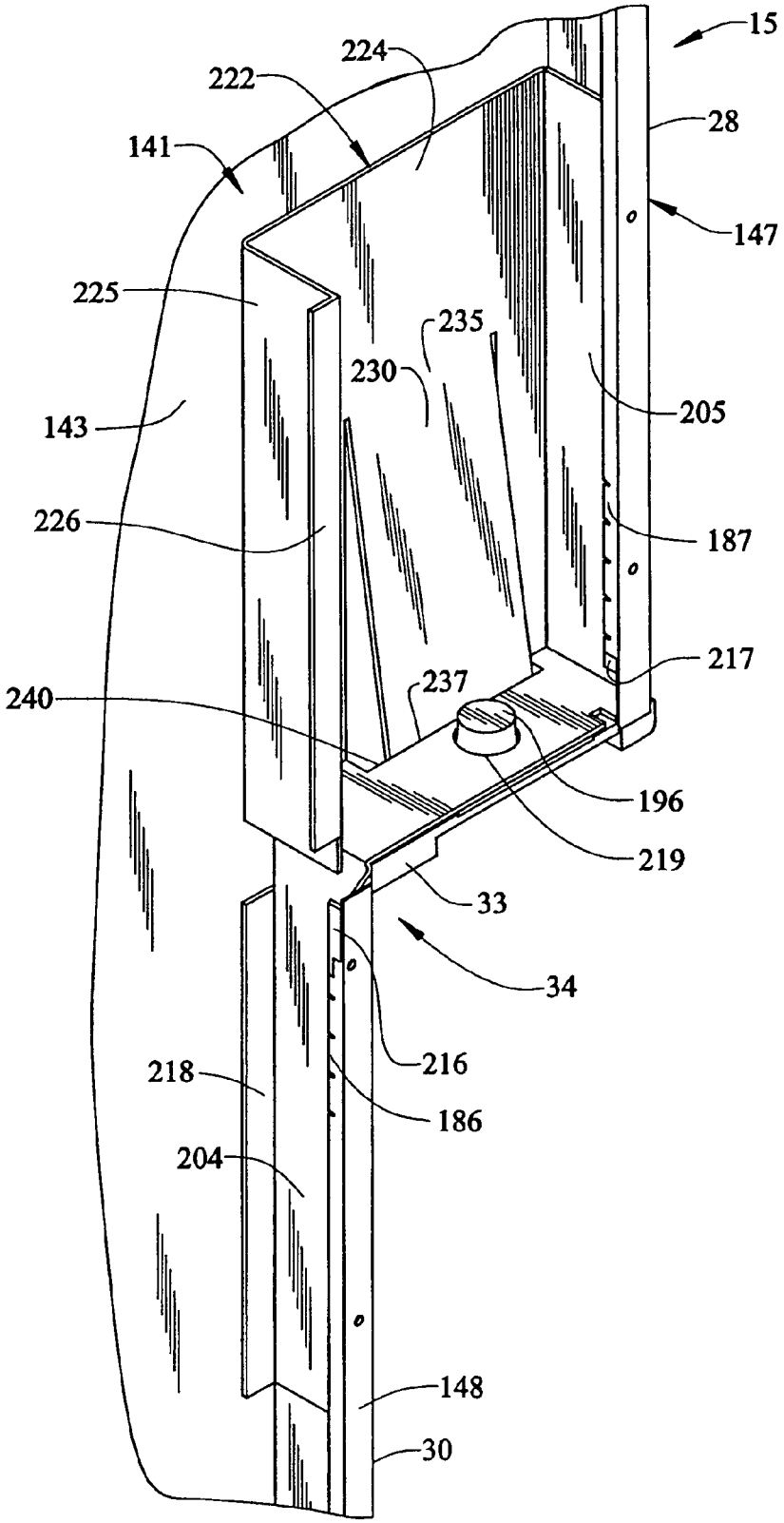
FIG. 7 is a partial perspective view of the door brace member of FIG. 6 shown mounted on a laterally offset portion of a varying width door.

Reference will now be made to FIGS. 6 and 7 in describing a door brace member 153' constructed in accordance with a second embodiment of the present invention. As shown, door brace member 153' includes a first vertical section 204 and a second vertical section 205 that are interconnected by a lateral section 207. In a manner similar to that described with respect to the previous embodiment, door brace member 153' includes first and second in-turned flanges 210 and 211 that enable door brace member 153' to nest within corresponding in-turned flanges 148, 147 on fresh food door 15 as represented in FIG. 7. As such, each of in-turned flanges 210, 211 includes an associated first segment 213, 214 that extend substantially perpendicularly from first and second vertical sections 204 and 205 respectively. In-turned flanges 210 and 211 also include a second segment 216, 217 that extends generally perpendicularly inward from first segments 213, 214 respectively. Also, door brace member 153' is provided with a support flange 218, extending from first vertical section 204 that rests against panel section 141 of fresh food door 15. In a manner similar to that described above with reference to door brace member 153, lateral section 207 is provided with a locating recess 219 that is adapted to receive locating member 196 to properly position door brace member 153' relative to laterally offset portion 34 of fresh food door 15.

In further accordance with the embodiment shown, door brace member 153' is provided with a back plate 222 that is adapted to rest against panel section 141 of fresh food door 15 to provide additional structural support such as, for example, handle 55. As such, back plate 222 includes a rear portion 224 and a side portion 225 that, together with second vertical section 205, forms a support channel (not separately labeled) having a substantially rectangular cross-section. In addition, side portion 225 is provided with a flange element 226 that provides support for a door liner (shown in FIG. 2 but not separately labeled). In still further accordance with the embodiment shown, arranged on back plate 222 is a leg member 230 having a first end 235 extending from rear portion 224 to a second, cantilevered end 237 that terminates at lateral section 207. Actually, lateral section 207 is provided with a notch or opening 240 through which extends leg member 230.

Based on the above discussion, it should be readily apparent that each door brace member 153, 153' provides increased structural support for fresh food door 15 so as to substantially eliminate potential thermal bowing, thereby assuring a consistency in gap 58 and, more particularly, an effective seal in order to prevent cold air from undesirably escaping from refrigerator 2. By providing in-turned flanges on door brace members 153 and 153', the structural support can be incorporated into fresh food door 15 without the need for additional fasteners and, as indicated above, is initially held in place through tab elements 186, 187. In any event, in a manner known in the art, once fresh food door 15 is formed, an insulating foam is injected between rear portion 143 and liner 150. The insulating foam not only prevents thermal conduction but also serves to further enhance the overall structural stability of fresh food door 15.

Although described with reference to preferred embodiments of the present invention, it should be readily apparent to one of ordinary skill in the art that various changes and/or modifications can be made to the invention without departing from the spirit thereof. For instance, while door brace member 153 or 153' is described in connection with fresh food door 15, a corresponding door brace member, such as that indicated at 155 in FIG. 2, is preferably incorporated into freezer door 18. In general, the invention is only intended to be limited to the scope of the following claims.

We claim:

1. A refrigerator cabinet assembly comprising:

a cabinet shell including a pair of laterally spaced side panels, a top panel interconnecting upper end portions of the laterally spaced side panels and an open frontal zone permitting access to within the cabinet shell;

at least one liner positioned within the cabinet shell, said at least one liner defining laterally spaced, fresh food and freezer compartments separated by a fore-to-aft extending divider wall, said divider wall including at least first and second interconnected upright portions which are laterally offset, wherein each of the fresh food and freezer compartments has varying lateral dimensions;

fresh food and freezer doors each including a front face portion, an inner panel portion and a liner extending along the inner panel portion, each of the fresh food and freezer doors further including an outer lateral portion pivotally mounted to the cabinet shell about a substantially vertical axis and an inner lateral portion defined by laterally offset sections, wherein the fresh food and freezer doors have vertically offset, varying widths portions adapted to extend across and seal the fresh food and freezer compartments respectively; and a door brace member provided along the inner panel portion and at the laterally offset section of at least one of the fresh food and freezer doors, said door brace member providing structural support for the varying width portions of the at least one fresh food and freezer doors.

2. The refrigerator cabinet assembly according to claim 1, wherein the laterally offset section includes a first substantially vertical member, a second substantially vertical member and a lateral member, said lateral member interconnecting the first and second substantially vertical members, wherein the door brace member extends along at least two of the first substantially vertical member, the second substantially vertical member and the lateral member.

3. The refrigerator cabinet assembly according to claim 2, wherein the door brace member includes a substantially vertical section and a lateral section.

4. The refrigerator cabinet assembly according to claim 2, wherein the door brace member includes first and second substantially vertical sections interconnected by a lateral section.

5. The refrigerator cabinet assembly according to claim 4, wherein the lateral section extends substantially horizontal.

6. The refrigerator cabinet assembly according to claim 4, wherein each of the substantially vertical sections of the door brace member includes an in-turned flange, said in-turned flange nesting within a corresponding in-turned flange provided on the at least one of the fresh food and freezer compartment doors.

7. The refrigerator cabinet assembly according to claim 6, wherein the in-turned flange of the door brace member extends along an edge portion of the substantially vertical section of the door brace member.

8. The refrigerator cabinet assembly according to claim 7, wherein at least one of the substantially vertical sections includes a support flange extending along an edge portion opposite the in-turned flange of the door brace member, said support flange being adapted to position the door brace member at the laterally offset section.

9. The refrigerator cabinet assembly according to claim 6, wherein the door brace member is mechanically retained at the laterally offset portion through at least one tab element.

10. The refrigerator cabinet assembly according to claim 9, wherein the door brace member is retained at the laterally offset portion through first and second sets of tab elements.

11. The refrigerator cabinet assembly according to claim 10, wherein at least the first set of tab elements extends from the in-turned flange provided on the at least one of the fresh food and freezer compartment doors.

12. The refrigerator cabinet assembly according to claim 4, wherein the lateral member includes a locating element and the lateral section includes a locating element receiver, said locating element being adapted to nest in the locating element receiver to position the door brace member at the laterally offset section.

13. The refrigerator cabinet assembly according to claim 4, wherein the door brace member includes a back plate provided between one of the first and second substantially vertical sections and the lateral section.

14. The refrigerator assembly according to claim 13, wherein the back plate includes a leg member extending to the lateral section.

15. The refrigerator cabinet assembly according to claim 4, wherein the first and second substantially vertical sections extend along the first and second substantially vertical members with the lateral section extends along the lateral member.

* * * * *